US007478736B2

(12) United States Patent
Morgan

(10) Patent No.: US 7,478,736 B2
(45) Date of Patent: Jan. 20, 2009

(54) ERGONOMIC FROSTING APPLICATOR

(76) Inventor: Fletcher Morgan, 4990 Coquina Key Dr., SE., St. Petersburg, FL (US) 33705

( * ) Notice: Subject to any disclaimer, the term of this patent is extended or adjusted under 35 U.S.C. 154(b) by 453 days.

(21) Appl. No.: 11/181,911

(22) Filed: Jul. 15, 2005

(65) Prior Publication Data

US 2007/0000943 A1 Jan. 4, 2007

Related U.S. Application Data

(63) Continuation-in-part of application No. 29/233,137, filed on Jun. 29, 2005, now Pat. No. Des. 520,807.

(51) Int. Cl.
*B65D 35/00* (2006.01)

(52) U.S. Cl. ..... 222/107; 222/568; 222/575

(58) Field of Classification Search ..... 222/107, 222/460, 462, 566, 568, 575; *B65D 35/00, B65D 35/38*

See application file for complete search history.

(56) References Cited

U.S. PATENT DOCUMENTS 1,272,921 A * 7/1918 Crump ..... 222/107
2,320,496 A * 6/1943 Wechsler ..... 425/461
3,847,523 A * 11/1974 Parrish et al. ..... 425/191
5,067,501 A * 11/1991 Auger ..... 132/116
5,114,044 A * 5/1992 Spanek, Jr. ..... 222/94
5,249,716 A * 10/1993 O'Sullivan ..... 222/568
5,816,450 A * 10/1998 Alexander et al. ..... 222/179
6,076,712 A * 6/2000 Esber et al. ..... 222/527
2004/0124210 A1 * 7/2004 Bartlein ..... 222/92

* cited by examiner

*Primary Examiner*—Kevin P Shaver
(74) *Attorney, Agent, or Firm*—John S. Hale; Gipple & Hale

(57) ABSTRACT

A hand-held icing dispenser for use by a person in decorating a cake with icing dispensed through an icing tip, comprising a dispensing nozzle constructed of an integrally formed cylindrical base section with a threaded exterior surface, an integral intermediate offset funnel section extending from said cylindrical base section and a tubular dispensing section extending from said funnel section positioned angularly from the center axis of the cylindrical base section. The tubular dispensing section has an external threaded portion at its distal end and a ring member is mounted on a threaded portion of the cylindrical base section to hold a flexible bag secured on the cylindrical base section. A decorator tip is removably mounted on said the tubular dispensing section.

9 Claims, 6 Drawing Sheets

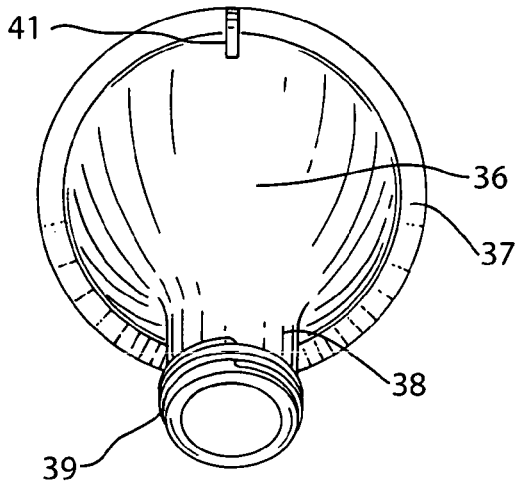
FIG. 5
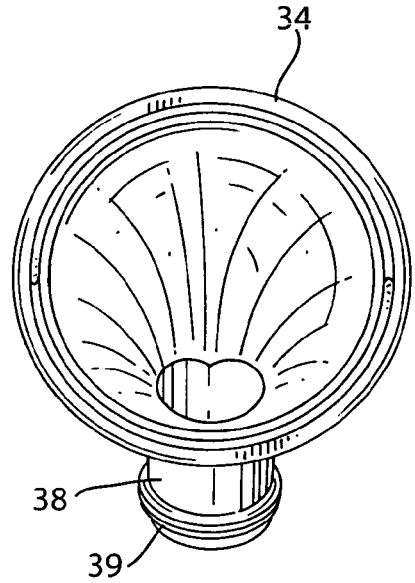
FIG. 6
FIG. 7
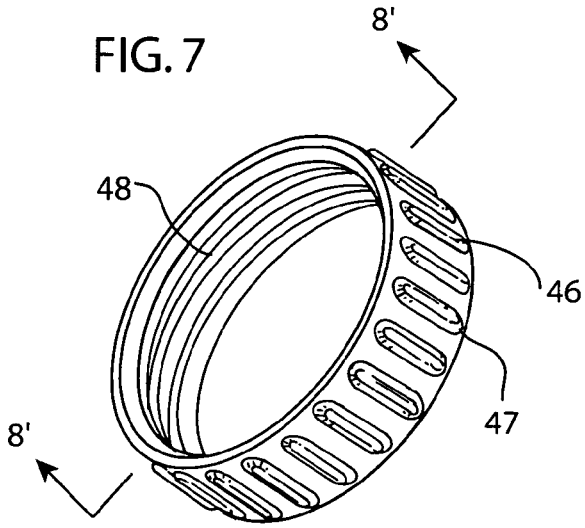
FIG. 8
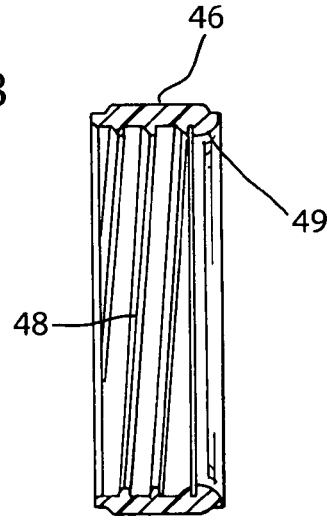

ERGONOMIC FROSTING APPLICATOR

CROSS-REFERENCE TO RELATED APPLICATIONS

This is continuation-in-part of Design Application Serial No. 29/233,137 which was filed Jun. 29, 2005 now U.S. Pat. No. D,520,807.

TECHNICAL FIELD OF THE INVENTION

The present invention relates generally to the field of hand held icing dispensers, and more particularly to an ergonomic icing dispenser which has an easily loadable and disposable icing bag and has the capability to easily change decorator tips.

BACKGROUND OF THE INVENTION

The application of decorating material to the top and sides of an iced cake is an art and the artist or cake decorator generally uses a device known as a pastry bag in a manner somewhat analogous to the manner a painter uses a brush. The material employed is in the nature of a confection that is sufficiently viscous as to hold its shape after being dispensed from the bag.

Recipes for making suitable decorating material are well known in the art and the material may be pre dyed or colored by food dyes. Ordinarily, separate pastry bags are used for each color being used Typically, a decorator tip is attached to an opening in the small collapsible pastry bag filled with icing. An operator squeezes the bag to force icing from the bag through the decorator tip as the operator manipulates the tip about a surface to artistically decorate the surface with the icing.

Various dispensers for cake icing are well-known, and usually comprise either a muslin bag having a base opening, or a syringe-type mechanical device. Muslin bag dispensers are relatively difficult to use, and are only practical for relatively large and skilled operations such as occur in bakeries and restaurants. Syringe-type dispensers are simple, but often fail to produce satisfactory results as the device tends to be unsteady in the user's hand, and it is also difficult to produce a steady flow of icing.

Dispensing guns for mastics and sealants are also well known, and these usually comprise a frame having a handle and a trigger which press together to operate a piston which extrudes the material from the nozzle of a cartridge, the piston being advanced in steps by a one-way drive which includes a releasable blocking plate. This arrangement has not proved suitable for "artistic" operations such as cake icing, as the remote nozzle tends to wander and the flow of material is not only difficult to control but also tends to be non-uniform and to continue after release of the trigger.

Other methods of dispensing cake icing comprise putting icing into collapsible paper cones that may be squeezed by the operator to dispense the icing through the tip of the cone. This method and apparatus requires a great deal of fatiguing effort on the part of the operator to squeeze the cone, as well as to move the tip of the cone about the cake to produce the desired icing decorations. Furthermore, the cone structure may, on occasion, rupture and therefore render the device useless. Because of the deficiencies in this particular method and apparatus, other types of dispensers have been employed to dispense cake icing.

In one example, a motorized apparatus for dispensing cake icing can be seen in U.S. Pat. No. 4,421,251 issued Dec. 20, 1983. This device utilizes an electric motor to squeeze a collapsible icing bag, thereby to dispense icing contained within the bag onto a cake.

Still another device of interest is a hand operated plunger dispenser of icing for cakes that is disclosed in U.S. Pat. No. 4,966,537 issued Oct. 30, 1990. This device dispenses icing through a cylinder and a plunger arrangement which is operated by a manual hand lever. The icing is dispensed through a nozzle which is clamped by a tapped ferrule.

U.S. Pat. No. 5,361,946 issued Nov. 8, 1994 discloses a pneumatic air gun similar to a calking gun for discharging icing onto a cake. In this device a nozzle is coupled to the nozzle mount by the use of a tubular fastener which may be threadably engaged to the reads on the nozzle mount.

An icing device using a collapsible substantially spherical bulb shaped container made of low density polyethylene which holds the icing is shown in U.S. Pat. No. 5,758,802 issued Jun. 2, 1998. The bulb body has a dome shaped snap on adaptor collar of greater rigidity than the bulb container cap. The adaptor collar is constructed to receive a screw on nozzle applicator tip U.S. Pat. No. 6,799,611 issued Oct. 5, 2004 is directed toward an automatic icing dispenser which feeds icing into a bag having a nozzle with a butterfly valve.

Another ergonomic icing applicator device by the inventor of the present application is shown in United States Design Pat. No. 496,216 issued Sep. 21, 2004.

The aforementioned apparatuses and methods allow a user to dispense icing onto a cake but they do not provide for both the rapid changing of icing styles or colors as well as the accurate and precise dispensing of cake icing. Some of the above mentioned devices must be flushed out and thoroughly cleaned before a different style or different color of icing may be dispensed. Other devices utilized for icing cakes create strain upon an operators wrist and are difficult to control which results in an icing dispenser that precludes accurate and artistic placement of icing on a cake. Furthermore, some of the devices utilized for icing cakes produce a stream of material that is both nonuniform in size and that continues to flow briefly after the release of the trigger mechanism.

Therefore, it can be appreciated that there exists a continuing need for a new viscous material dispenser which utilizes interchangeable icing cartridges for rapid and easy changing of icing styles. There is also a need to reduce the stress placed upon an operator's arm, and a dispenser system that will dispense cake icing in a controllable and artistic manner. In this regard, the present invention substantially fulfills these needs.

SUMMARY OF THE INVENTION

The present invention is directed toward a an ergonomic icing applicator device having a funnel shaped applicator with a cylindrical tubular neck angled with respect to the central axis of the device. The end of the tubular neck is threaded to receive specialized tips that have specific decorative aperture, the tips also being formed with a housing having an internal thread which screws onto the neck. The base of the funnel is cylindrical and is formed with an external thread to receive a bag locking ring which locks the icing bag between the interior diameter of the locking ring and the exterior outer diameter of the cylindrical base of the funnel shaped applicator.

It is therefore an object of the present invention to provide a new viscous material dispenser which has many of the advantages of the cake icing dispensers mentioned heretofore and many novel features that result in a viscous material dispenser which is not anticipated, rendered obvious, suggested, or even implied by any of the prior art cake icing dispensers.

It is another object of the present invention to provide a new viscous material dispenser which may be easily and efficiently manufactured.

It is a further object of the present invention to provide a new viscous material dispenser which is of a durable and reliable construction.

It is yet another object of the present invention to provide an improved but relatively simple dispenser for use primarily in the decorative icing of cakes, which is easy to operate while producing very satisfactory results.

An even further object of the present invention is to provide a new viscous material dispenser which is susceptible of a low cost of manufacture with regard to both materials and labor, and which accordingly is then susceptible of low prices of sale to the consuming public, thereby making such viscous material dispensers economically available to the buying public.

Still another object of the present invention is to provide a new viscous material dispenser which utilizes interchangeable icing bags to facilitate easy changing of an icing type or color without significant cleaning of the device.

Even still another object of the present invention is to provide a new viscous material dispenser which will produce a stream of material that is uniform in size and that immediately ceases to flow when the operator stops application.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

These and other objects, advantages, and novel features of the present invention will become apparent when considered with the teachings contained in the detailed disclosure along with the accompanying drawings.

BRIEF DESCRIPTION OF THE DRAWINGS

FIG. 5 is a front elevational view of the applicator head of FIG. 3;

FIG. 6 is a rear elevational view of the applicator head of FIG. 3;

FIG. 7 is a perspective view of the locking ring;

FIG. 8 is a cross sectional view of the locking ring of FIG. 7 taken along line 8'-8' of FIG. 7;

DETAILED DESCRIPTION OF THE INVENTION

Figure 1:
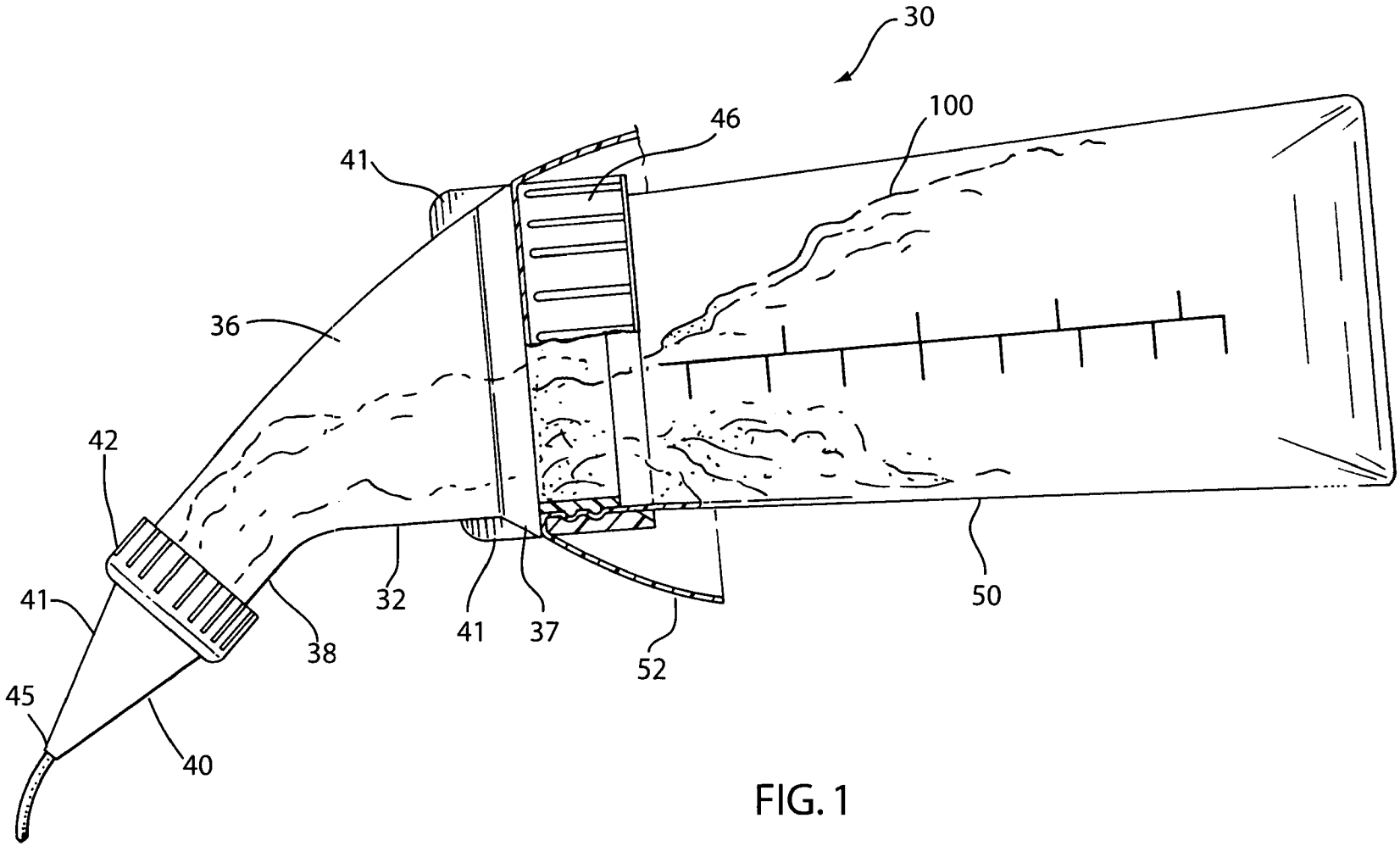
FIG. 1 shows a perspective view of the applicator device with the locking ring partially broken away.

The preferred embodiment and best mode of the invention is shown in FIGS. 1 through 8. The icing applicator 30 is constructed with an ergonomically shaped applicator head 32 constructed with a cylindrical base section 34 which has external thread 35, an integral hollow funnel section 36 with a cylindrical tube section or neck 38 having an external thread 39 on its distal end. The applicator head is preferably made from plastic by injection molding. However, other materials such as stainless steel, copper or the like can be used. The funnel section 36 is preferably offset as can be seen in FIGS. 1-6, that is its side wall is not uniformly angled and has its proximal end flared outward at 37 so that it forms a step 43 down to the outer surface of the cylindrical base section outer surface. The step 43 has a vertical planar surface which extends away from the cylindrical base section outer surface. Two opposing flanges 41 are formed on the outer surface of the funnel section 36 to allow easy grasping of the funnel section when icing is being applied and when the flexible plastic bag 50 is being locked onto the threaded surface of the cylindrical base section of the icing applicator by locking ring 46. The locking ring 46 has spaced external ribs 47 positioned around its outer surface which allow easy grasping and turning by the user and has an inner diameter which is greater than the outer diameter of the cylindrical base section. The inner surface of the locking ring 46 is internally threaded 48 as is shown in FIGS. 7 and 8 and has an end stop 49.

It will be appreciated that the tube shaped neck 38 of funnel section 36 is angled away from the center axis of the base section 34, the funnel section 36 itself being angled away from the center axis of the cylindrical base section 34. The tube section 38 projects past an extended phantom cylinder drawn from the cylindrical base section 34. The threaded area 39 is adapted to received and hold a decorator tip 40. The decorator tip 40 is constructed with a cylindrical skirt portion 42 having an interior diameter which is greater than the outer diameter of the tube shaped end 38, the interior surface of the skirt portion 42 being internally threaded to be mounted on and secured to the threads 39 of the tube shaped end 38. A funnel portion 44 is integral with the skirt member 42 and extends outward from the cylindrical skirt portion. The distal end 45 of the funnel portion forms a shaped aperture 48 which causes the icing which is extruded out the funnel to have a shaped configuration.

Figure 2:
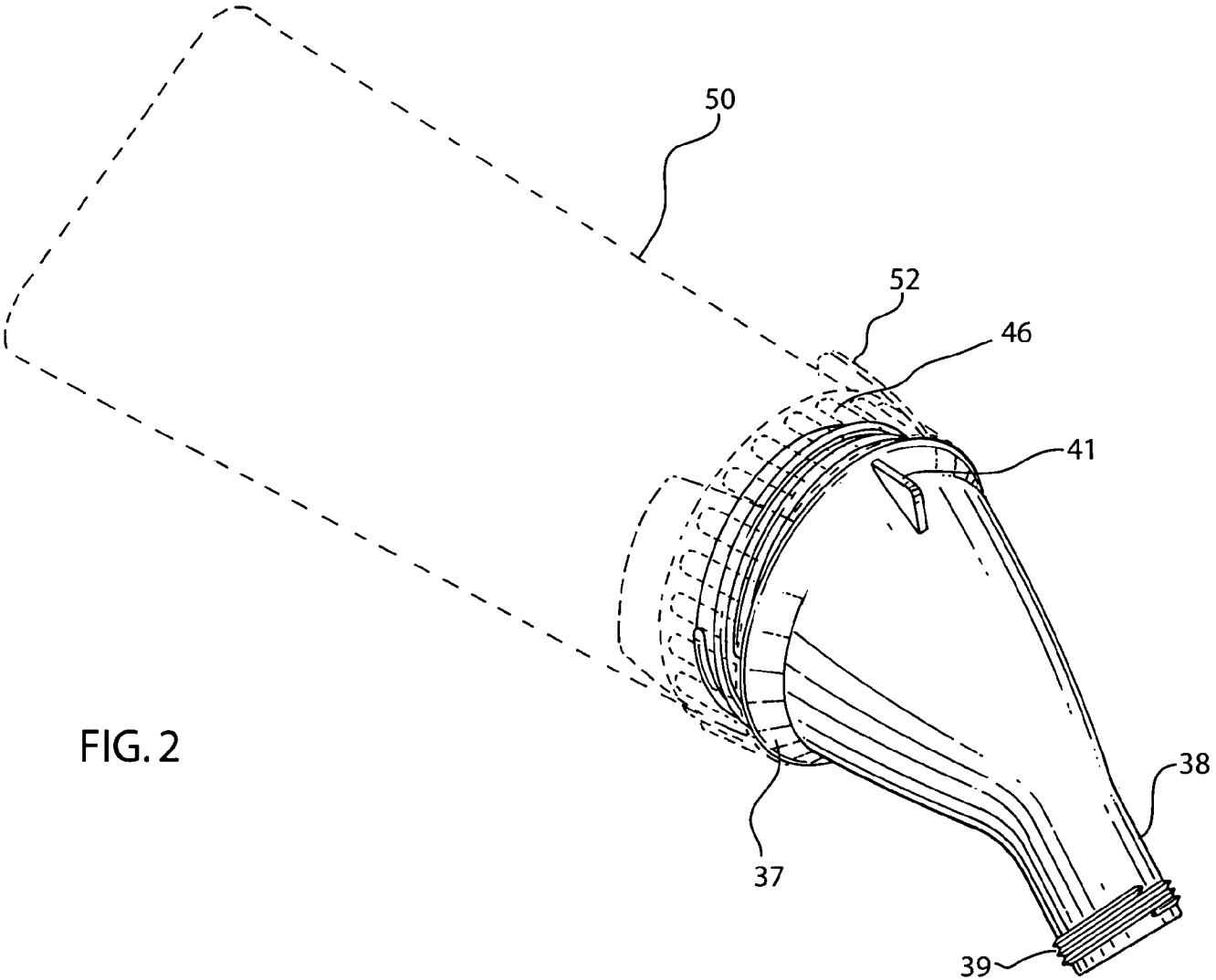
FIG. 2 is a perspective reverse view of the device shown in FIG. 1 with the tip removed and the locking ring and icing bag shown in phantom.
Figure 3:
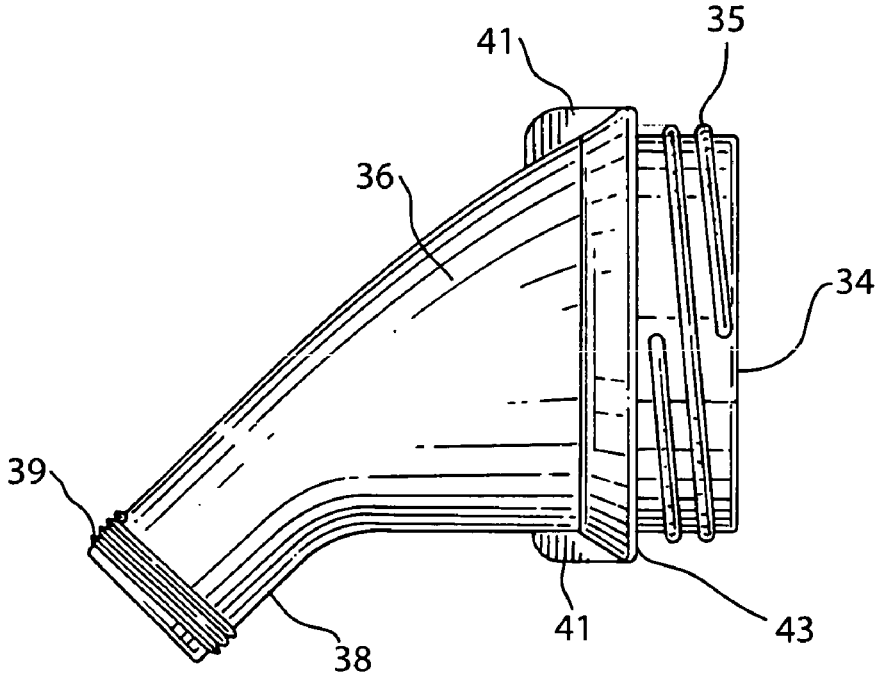
FIG. 3 is a side elevational view of the applicator head.
Figure 4:
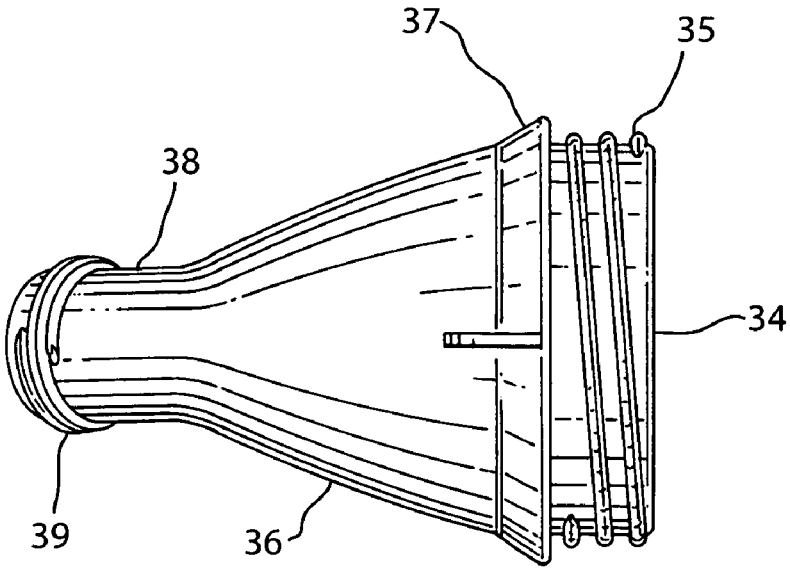
FIG. 4 is a top plan view of the applicator head of FIG. 3.

A flexible plastic bag 50 which is preferably transparent allowing the user to view the icing is shown in FIGS. 1 and 2. A nurser bottle bag can be used in the invention to hold the icing. The open end 52 of the bag as shown in FIG. 1 extends past the cylindrical base section 34 and after it is locked in place by locking ring 46 it is folded back over the locking ring.

Figure 9:
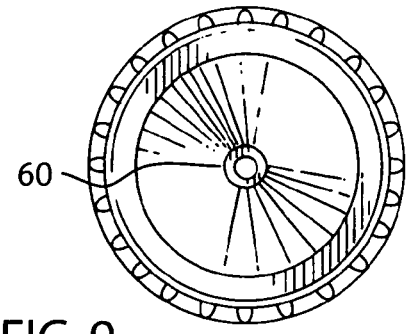
FIG. 9 is an enlarged front elevational view of a round icing tip which can be mounted on the applicator head as shown in FIG. 1.
Figure 10:
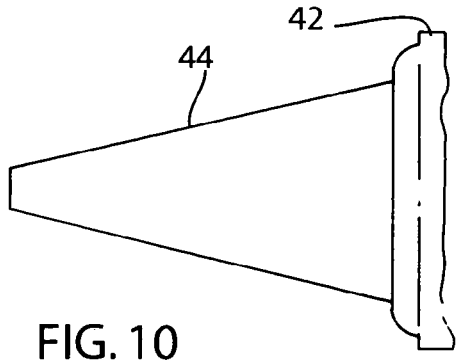
FIG. 10 is a side elevational view of the tip shown in FIG. 9 with the tip housing partially broken away.
Figure 11:
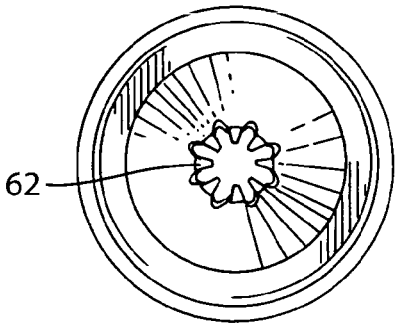
FIG. 11 is an enlarged front elevational view of a star icing tip which can be mounted on the applicator head as shown in FIG. 1.
Figure 12:
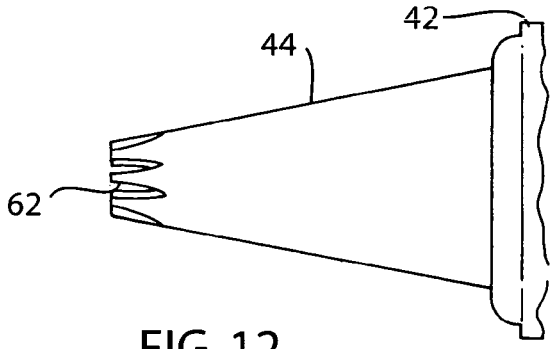
FIG. 12 is a side elevational view of the tip shown in FIG. 11 with the tip housing partially broken away.
Figure 13:
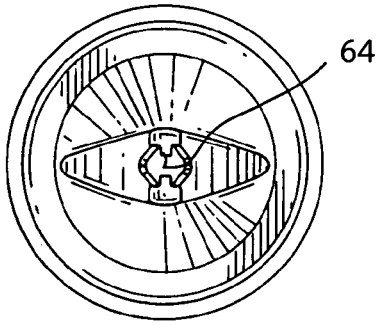
FIG. 13 is an enlarged front elevational view of a leaf icing tip which can be mounted on the applicator head as shown in FIG. 1.
Figure 14:
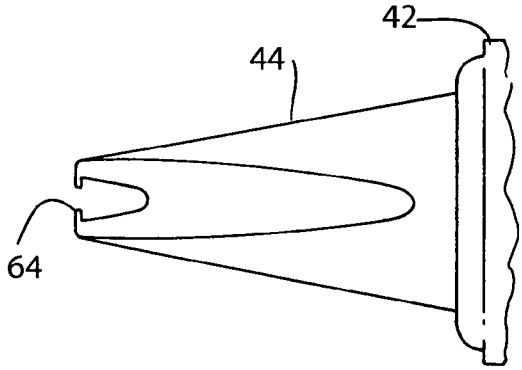
FIG. 14 is a side elevational view of the tip shown in FIG. 13 with the tip partially broken away.
Figure 15:
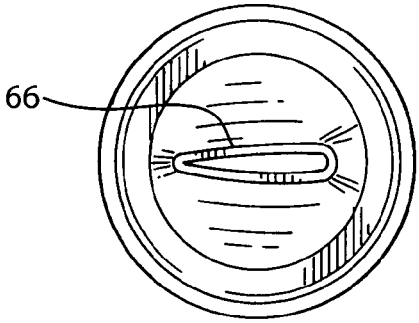
FIG. 15 is an enlarged front elevational view of a petal icing tip which can be mounted on the applicator head as shown in FIG. 1.
Figure 16:
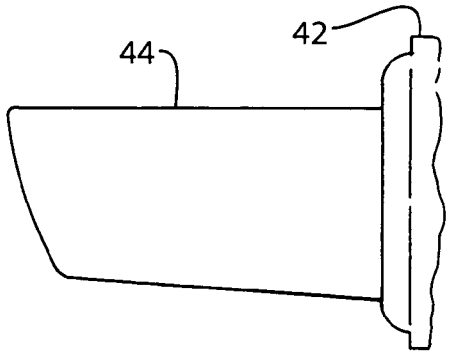
FIG. 16 is a side elevational view of the tip shown in FIG. 15 with the tip partially broken away.
Figure 17:
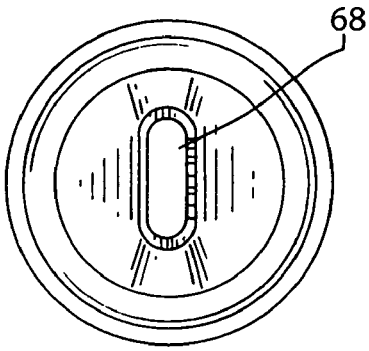
FIG. 17 is an enlarged front elevational view of a basket weave icing tip which can be mounted on the applicator head as shown in FIG. 1.
Figure 18:
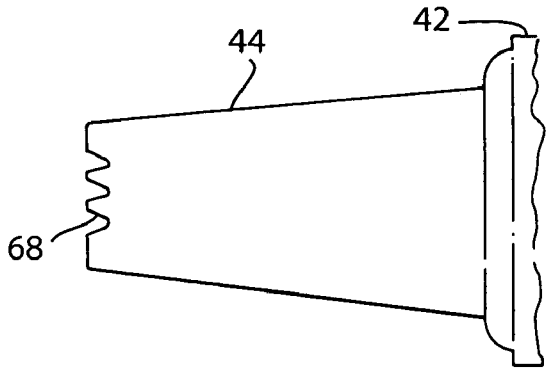
FIG. 18 is a side elevational view of the tip shown in FIG. 17 with the tip partially broken away.
Figure 19:
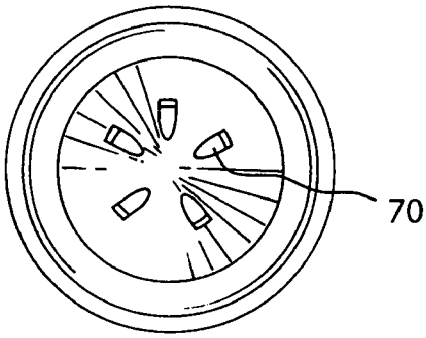
FIG. 19 is an enlarged front elevational view of a flower icing tip which can be mounted on the applicator head as shown in FIG. 1.
Figure 20:
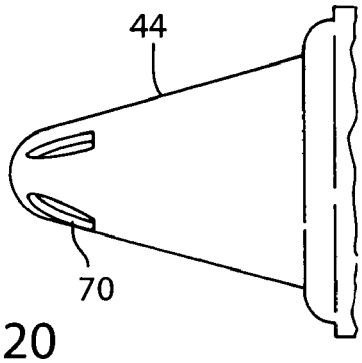
FIG. 20 is a side elevational view of the tip shown in FIG. 19 with the tip partially broken away.
Figure 21:
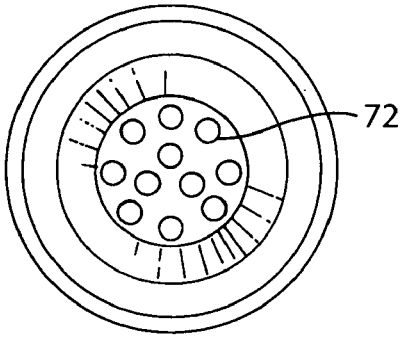
FIG. 21 is an enlarged front elevational view of a confetti icing tip which can be mounted on the applicator head as shown in FIG. 1.
Figure 22:
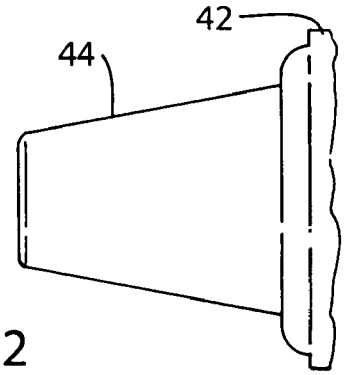
FIG. 22 is a side elevational view of the tip shown in FIG. 21 with the tip partially broken away.
Figure 23:
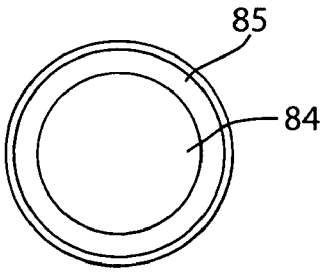
FIG. 23 is an enlarged front elevational view of a universal adaptor tip which can be mounted on the applicator head to hold metal applicator tips previously owned.
Figure 24:
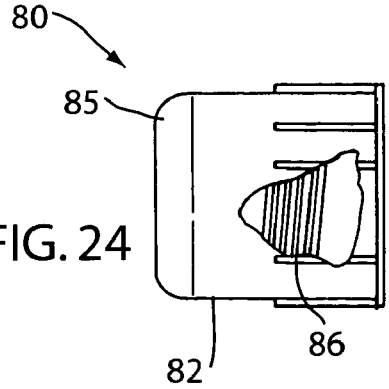
FIG. 24 is a side elevational view of the tip shown in FIG. 23.

A number of decorator tips 40 can be used on the tube shaped neck 38. The round tip 60 as shown in FIGS. 9 and 10, is used to produce icing dots, writing and lines and confetti on the surface of the cake. The star tip 62 as shown in FIGS. 11 and 12 is used to make icing shells, braided rope and loop borders. The leaf tip 64 as shown in FIGS. 13 and 14 is used to make icing leaves. The petal tip 66 as shown in FIGS. 15 and 16 is used to make icing roses, zig-zag garlands, blossoms and basket weave. The basket weave tip 68 as shown in FIGS. 17 and 18 is used to make an icing basket weave or cross ribbons. The flower tip 70 as shown in FIGS. 19 and 20 is used to make icing flowers. The confetti tip 72 as shown in FIGS. 21 and 22 is used to allow strings to drop onto the cake in overlapping loops and circles and the universal coupler tip 80 as shown in FIGS. 23 and 24 is used with small sized metal decorating tips previously owned by the users. The metal tip is dropped into the coupler housing 82 with the funnel extending outside the aperture 84 and is attached to the decorator nozzle by tightening the threads 86 over the threads 39 of the tube section 38. The aperture 84 is defined by an inwardly curved wall 85. The internal threads 86 of the housing or skirt are threaded to fit over tube threads 39 until the metal tip is snug.

In operation of the icing applicator, the cylindrical base section 34 of the icing applicator 30 is separated from the locking ring 46 by turning the ring portion counter-clockwise. The icing bag 50 is inserted into the ring pulling the edges 52 of the bag 50 down over the outside surface of ring 46. The bag is filled with frosting or icing 100 and leaving the edges 52 of the bag over the outside of the ring 46 at which time the cylindrical base section 34 is reattached by screwing the same into the threaded interior of the ring. The desired decorator tip 40 is attached to the thread 39 of the tube 38 by turning the same clockwise. The decorator tip 40 should be firmly attached but capable of being further turned to all the operator to have the tip opening at the best angle for application. The bag is then squeezed to extrude the icing through the tip opening to begin decorating.

The principles, preferred embodiments and modes of operation of the present invention have been described in the foregoing specification. However; the invention should not be construed as limited to the particular embodiments which have been described above. Instead, the embodiments described here should be regarded as illustrative rather than restrictive. Variations and changes may be made by others without departing from the scope of the present inventions defined by the following claims.

What is claimed is:

1. A hand-held icing dispenser for use by a person in decorating a cake with icing dispensed through an icing tip, comprising, a dispensing nozzle with a cylindrical base section having a threaded exterior surface, an intermediate funnel section integrally formed with said cylindrical base section, said funnel section being formed with a tubular dispensing section angularly extending away from the center axis of the cylindrical base section, said funnel section forming a flared end which extends out past the outer surface of said cylindrical base forming a stop, said tubular dispensing section having an external threaded section at its distal end, a ring member adapted to be mounted to said cylindrical base section to hold a flexible bag secured to said cylindrical base section, and a decorator tip removably mounted on said the tubular dispensing section.

2. A hand held icing dispenser for use by a person in decorating a cake with icing as claimed in claim 1 wherein said ring member has a plurality of ribs extending outwardly from the surface of the ring and is internally threaded.

3. A hand held icing dispenser for use by a person in decorating a cake with icing as claimed in claim 1 wherein said ring member has an interior stop which limits the distance that said ring can be threaded along said cylindrical base section.

4. A hand held icing dispenser for use by a person in decorating a cake with icing as claimed in claim 1 wherein said funnel section has a plurality of flange members extending outward from said funnel section surface.

5. A hand held icing dispenser for use by a person in decorating a cake with icing as claimed in claim 4 wherein said plurality of flanges are positioned on said funnel section surface opposite from each other.

6. A hand held icing dispenser for use by a person in decorating a cake with icing as claimed in claim 1 wherein said funnel section is offset.

7. A hand held icing dispenser for use by a person in decorating a cake with icing as claimed in claim 1 wherein said decorator tip comprises a universal adapter tip constructed with a cylindrical skirt portion with an internal threaded surface and a cylindrical top portion having a central aperture defined by an inwardly curved wall of the distal end of said cylindrical top portion.

8. A hand held icing dispenser for use by a person m decorating a cake with icing as claimed in claim 1 wherein said flexible bag is constructed of plastic.

9. A hand-held icing dispenser for use by a person in decorating a cake with icing dispensed through an icing tip, comprising, a dispensing nozzle constructed of a cylindrical base section with a threaded exterior surface, an integral intermediate offset funnel section extending from said cylindrical base section, said offset funnel section being formed with a tubular dispensing section angularly extending away from the center axis of the cylindrical base section, said offset funnel section forming a flared end proximal portion which extends out past the outer surface of said cylindrical base forming a stop and a plurality of flanges which extend outward from said funnel outer surface to aid in grasping said dispensing nozzle, said tubular dispensing section being formed with an external threaded portion at its distal end, a ring member having an interior diameter greater than the outer diameter of said cylindrical base section and provided with interior threads for mounting on the threaded exterior surface of said cylindrical base section to hold a flexible bag secured on said cylindrical base section, said ring member being provided with an outer surface which defines protuberances; and a decorator tip removably mounted on said the tubular dispensing section, said decorator tip formed with a cylindrical skirt portion having an internal threaded surface and a funnel portion integral with said skirt portion and extending away from said skirt portion, said funnel portion defining at least one shaped aperture cut in it distal end.

* * * * *